US007308760B2

(12) United States Patent
Horimura et al.

(10) Patent No.: US 7,308,760 B2
(45) Date of Patent: Dec. 18, 2007

(54) METHOD OF MAKING A VALVE LIFTER

(75) Inventors: Hiroyuki Horimura, Saitama (JP); Kosuke Doi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/375,325

(22) Filed: Mar. 14, 2006

(65) Prior Publication Data

US 2006/0213472 A1 Sep. 28, 2006

(30) Foreign Application Priority Data

Mar. 24, 2005 (JP) ..... 2005-086142

(51) Int. Cl.
*B21K 1/76* (2006.01)
*B21K 1/22* (2006.01)
*B21K 1/20* (2006.01)

(52) U.S. Cl. ..... 29/888.03; 29/888.43; 29/888.4; 29/458; 29/527.1; 123/90.51; 123/90.61

(58) Field of Classification Search ..... 29/888.03, 29/888.4, 458, 527.1, 888.43; 123/90.61, 123/90.48, 90.52, 90.51
See application file for complete search history.

(56) References Cited

U.S. PATENT DOCUMENTS 4,509,803 A * 4/1985 Takenaka et al. ..... 384/13
5,129,372 A * 7/1992 Seiberth et al. ..... 123/90.48
5,743,224 A * 4/1998 Hosaka et al. ..... 123/90.51
5,879,816 A * 3/1999 Mori et al. ..... 428/621

FOREIGN PATENT DOCUMENTS

JP 09-195723 7/1997

* cited by examiner

*Primary Examiner*—David P. Bryant
*Assistant Examiner*—Sarang Afzali
(74) *Attorney, Agent, or Firm*—Carrier, Blackman & Associates, P.C.; William D. Blackman; Joseph P. Carrier

(57) ABSTRACT

A valve lifter and a method of manufacture thereof is provided in which sliding properties of a cam on a cam-contacting sliding surface in an upper surface of a valve lifter are improved by forming the cam-contacting sliding surface as a concave surface to permit retention of lubricating oil therein. The cam-contacting sliding surface is integrally provided in an outer wall of an upper part of a valve lifter. The cam-contacting sliding surface is formed as a concave surface to provide better retention of the lubricating oil. The concave sliding surface is formed during high temperature oxidation of the valve lifter by permitting the natural slumping down of the upper part due to its own weight under the gravity.

7 Claims, 5 Drawing Sheets

CUTOUT OF BILLET

PRODUCTION OF PRIMARY PROCESSED PRODUCT BY HOT FORGING

PRODUCTION OF SECONDARY PROCESSED PRODUCT FINISHED IN PREDETERMINED SIZE BY MACHINING

PRODUCTION OF TERTIARY PROCESSED PRODUCT WITH HARDENED LAYER FORMED BY OXIDATION IN HEATING FURNACE

DURING OXIDATION

COOLING AFTER OXIDATION AND SURFACE FINISHING FOR FORMATION OF VALVE LIFTER

PRIOR ART

METHOD OF MAKING A VALVE LIFTER

CROSS-REFERENCE TO RELATED APPLICATIONS

The present invention claims priority under 35 USC 119 based on Japanese patent application No. 2005-086142, filed on Mar. 24, 2005. The subject matter of these priority documents is incorporated by reference herein.

BACKGROUND OF THE INVENTION

1. Field of the Invention

The present invention relates to a valve lifter, and to a method of manufacturing the same. Specifically, the present invention relates to a valve lifter, and a method of making the valve lifter, in which a cam-contacting sliding surface is concave in shape, and is formed in an upper surface of the valve lifter.

2. Description of the Background Art

Valve lifters are generally well known in the art of internal combustion engines, and have been conventionally used for many years. A valve lifter, as a component of a valve train of an internal combustion engine, includes a sliding surface on which a cam slides repeatedly during engine operation. The sliding surface is exposed to severe sliding conditions, and measures for improving durability and improved cam sliding properties on the sliding surface have long been studied. An effective measure for improving lubricating properties on the cam-contacting sliding surface has been especially required. In these circumstances, a shimmed valve lifter is known as a measure for improving the cam sliding properties by improving the lubricating properties on the cam-contacting sliding surface, for example, in which a shim is disposed in an upper surface of the valve lifer, forming a sliding surface on which a cam slides. In this known lifter, the upper surface of the shim is formed having a concave portion thereon. This is disclosed, for example, in Japanese Patent Laid-open Publication No. 9-195723 (p. 3 to 4, FIG. 1). FIG. 4 of the drawings in the present application is a reproduction of a drawing from Japanese Patent Laid-open Publication No. 9-195723, and is included herein for purposes of illustration and comparison.

In the lifter design of Japanese Patent Laid-open Publication No. 9-195723, the cam 06, including a cam surface 07 with a linear cross section, is brought into sliding contact with the shim 04 at a position offset from the center of the valve lifter. Rotational speed of the shim 04 is therefore increased, thus theoretically improving the capability of lubrication oil to form an oil film therebetween.

As shown in FIG. 4, the valve lifter described in the above Japanese Patent Laid-open Publication No. 9-195723 includes a disk-shaped shim 04 having a sliding surface 05, on which a cam slides, on the upper surface 02 of the valve lifter 01. The shim 04 is fit loosely in a socket formed in the upper surface 02 of the lifter, as shown, to enable the shim to rotate relative to the upper surface 02 of the valve lifter 01 during engine operation. The shim 04 is held in place by an annular protruding wall 03 provided in the outer periphery of the upper surface 02 of the valve lifter 01 so as to define a socket for housing the shim, and prevent the valve lifter 01 from being disengaged. The upper surface 05 of the disk-shaped shim 04 is a concavely curved sliding surface on which the cam slides. The cam 06, which is brought into sliding contact with the sliding surface 05, includes a cam surface 07 with a linear cross section. Moreover, the cam 06 is provided to be disposed at a position axially offset relative to a center axis 0X-0X of the shim 04 and valve lifer 01 (see a cam center line 0Y-0Y).

Accordingly, the cam 06 is brought into sliding contact with the valve lifter 01 at a position that is offset outwardly relative to the center position, that is, the lowest position in the substantially concavely curved sliding surface 05 of the disk-shaped shim 04. Furthermore, the cam 06 includes the cam surface 07, which has a linear cross section. The cam surface 07 is brought into sliding contact with the concavely curved sliding surface 05 at a corner portion 08 of the cam lobe, that is close to the outer periphery. This speeds up the rotation of the shim 04 accompanied with rotation of the cam 06 to increase the rate of lubricating oil being drawn onto the sliding surface 05, which is a portion where the cam surface 07 and the shim 04 are brought into sliding contact with each other, thus improving the capability of lubricating oil to form an oil film.

However, in this known design, providing the above-described shim in the upper surface of the valve lifer increases the weight and complexity of the valve lifter assembly. The weight increase is opposed to a goal of weight reduction of the valve lifter. Moreover, the weight increase of the valve lifter increases inertia of the valve lifter, thus degrading an ability of the valve lifter to follow the valve opening and closing in high-speed operations. Furthermore, the shim, having a special shape, is formed as a separate body from the body of the valve lifer, complicating the structure. Moreover, the number of man-hours required to manufacture the valve lifter is increased, and accordingly, the manufacturing cost increases.

As described above, the concave sliding surface stabilizes the rotation of the valve lifter and facilitates retaining lubricating oil on the sliding surface. However, on the other hand, there is a problem of lower resistance to wear and scuff in a severe operating situation, since the surface pressure increases in the outer portion which is brought into contact with the cam. The concave valve lifter, therefore, has not been put into significant effective practical use heretofore.

SUMMARY OF THE INVENTION

The present invention relates to a valve lifter designed to solve the aforementioned problems, and to a method of manufacturing the inventive lifter. A first aspect of the present invention relates to a valve lifter including a sliding surface, on which a cam lobe slides repeatedly during engine operation. The sliding surface is integrally formed as an upper surface of a body of the valve lifter, and is characterized in that the integrally formed sliding surface has a concave shape.

A second aspect of the present invention is characterized in that the above concave shape of the sliding surface has a maximum depth of not more than 20 μm.

Furthermore, a third aspect of the present invention is characterized in that the above-described valve lifter is formed of a titanium alloy, for increased strength and durability, and for improved flexibility.

In a fourth aspect of the present invention, a method of manufacturing a valve lifter is provided. The valve lifter is formed of titanium alloy in which a sliding surface, on which a cam slides, is integrally formed as an upper surface of a body of the valve lifter. In the method of manufacturing the valve lifter, the entire body of the valve lifter may be subjected to an oxidation treatment. In one illustrative example, the method includes steps of orienting the valve lifter with the sliding surface facing upwardly, and performing the oxidation treatment for the valve lifter. The manufacturing method results in a valve lifter having the sliding surface formed in a concave shape.

Furthermore, a fifth aspect of the present invention is characterized in that a protrusion is provided extending downwardly at a lower surface of an upper part of the lifter, for abutting on a tip portion of an intake or exhaust valve, either directly or with an inner shim interposed therebetween. The protrusion is formed extending downwardly in a central portion of an inner surface of an upper part of the valve lifter.

Moreover, a sixth aspect of the present invention is characterized in that before the oxidation treatment, a sliding surface of the valve lifter is formed in a convex shape.

According to the first aspect of the present invention, a valve lifter includes a sliding surface, on which a cam slides repeatedly during engine operation. The sliding surface is integrally formed as an upper surface of a body of the valve lifter. The invention is characterized in that the integrally formed sliding surface has a concave shape. Accordingly, lubricating oil can be retained on the cam-contacting sliding surface, to improve lubrication properties between the valve lifter and the cam. Moreover, special additional structural components are not required, therefore, the structure of the valve lifter is simplified. Accordingly, it is possible to reduce the weight of the valve lifter and reduce the manufacturing cost thereof.

According to the second aspect of the present invention, in addition to the first aspect, the above concave shape has a maximum depth of not more than 20 μm. When the depth is greater than 20 μm, the sliding surface only comes into contact with the outer peripheral edge of the cam, and uneven wear can occur. When the depth is not larger than 20 μm, it is possible to prevent the sliding surface from coming into contact only with the outer peripheral edge of the cam, whereby uneven wear is suppressed.

Furthermore, according to the third aspect of the present invention, in addition to that of the first aspect, the valve lifter is formed of titanium alloy. Accordingly, compared with a valve lifter made of a harder metal, it is possible to distribute the contact between the valve lifter and the cam by taking advantage of the elastic characteristics of the titanium alloy, which has a relatively small Young's modulus, whereby uneven wear is suppressed.

The Young's modulus of titanium is smaller than that of steel. Accordingly, when pressure applied to the sliding surface, on which the cam slides, increases, the valve lifter is elastically deformed to increase an area which comes into contact with the cam. Load is therefore received over a wider area, so that an increase in pressure on the sliding surface is suppressed. The concave sliding surface of the valve lifter, formed of titanium alloy, stabilizes rotation of the valve lifter and holds lubricating oil on the sliding surface. Moreover, the resistance to wear at the outer periphery of the sliding surface is maintained.

According to the fourth aspect of the present invention, a method of manufacturing a valve lifter is provided. The valve lifter is formed of titanium alloy and includes a sliding surface, on which a cam slides, that is integrally formed as an upper surface of a lifter body of the valve lifter. In the method of manufacture, the entire body of the valve lifter may be subjected to an oxidation treatment. The method includes the steps of: orienting the valve lifter such that the sliding surface, on which the cam slides, is facing upwardly, and performing the oxidation treatment for the valve lifter. As a result of the oxidation treatment, the sliding surface of the valve lifter is formed into a concave shape. In particular, due to heating at high temperature during the oxidation treatment, the upper surface of the valve lifter hangs down, or slumps, relative to the remaining portions of the valve lifter, so as to be slightly depressed in the center part thereof, because of its own weight under the action of gravity, thus forming the concave surface by itself. Thus, the concave cam-contacting sliding surface of the valve lifter can be easily formed, by using the inherent weight of the upper part of the valve lifter, without any special processing. Accordingly, the number of required manufacturing man-hours and manufacturing cost can be reduced.

According to the fifth aspect of the present invention, in addition to the fourth aspect, a protrusion, for abutting on a tip portion of an intake or exhaust valve directly, or with an inner shim interposed therebetween, is formed in the center of an inner surface of an upper part of the valve lifter. When the protrusion is formed in the center of the inner surface of the upper part of the valve lifter, the upper part is the heaviest at the center, and the center position of the concave portion of the sliding surface can substantially match the center position of the upper part, thus increasing the forming accuracy. Furthermore, changing the shape of the protrusion changes the shape of the concave portion of the sliding surface, whereby the shape of the sliding-surface can be adjusted. Moreover, it is possible to adjust the rigidity of the sliding surface in operation.

According to the sixth aspect of the present invention, in addition to the fourth or fifth aspects, a sliding surface of the valve lifter before the oxidation treatment is formed into a convex shape. This permits adjustment of the depth of the concave sliding surface after the oxidation treatment.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

A selected illustrative embodiment of the invention will now be described in some detail, with reference to FIGS. 1-4. It should be understood that only structures considered necessary for clarifying the present invention are described herein. Other conventional structures, and those of ancillary and auxiliary components of the system, are assumed to be known and understood by those skilled in the art.

Figure 1:
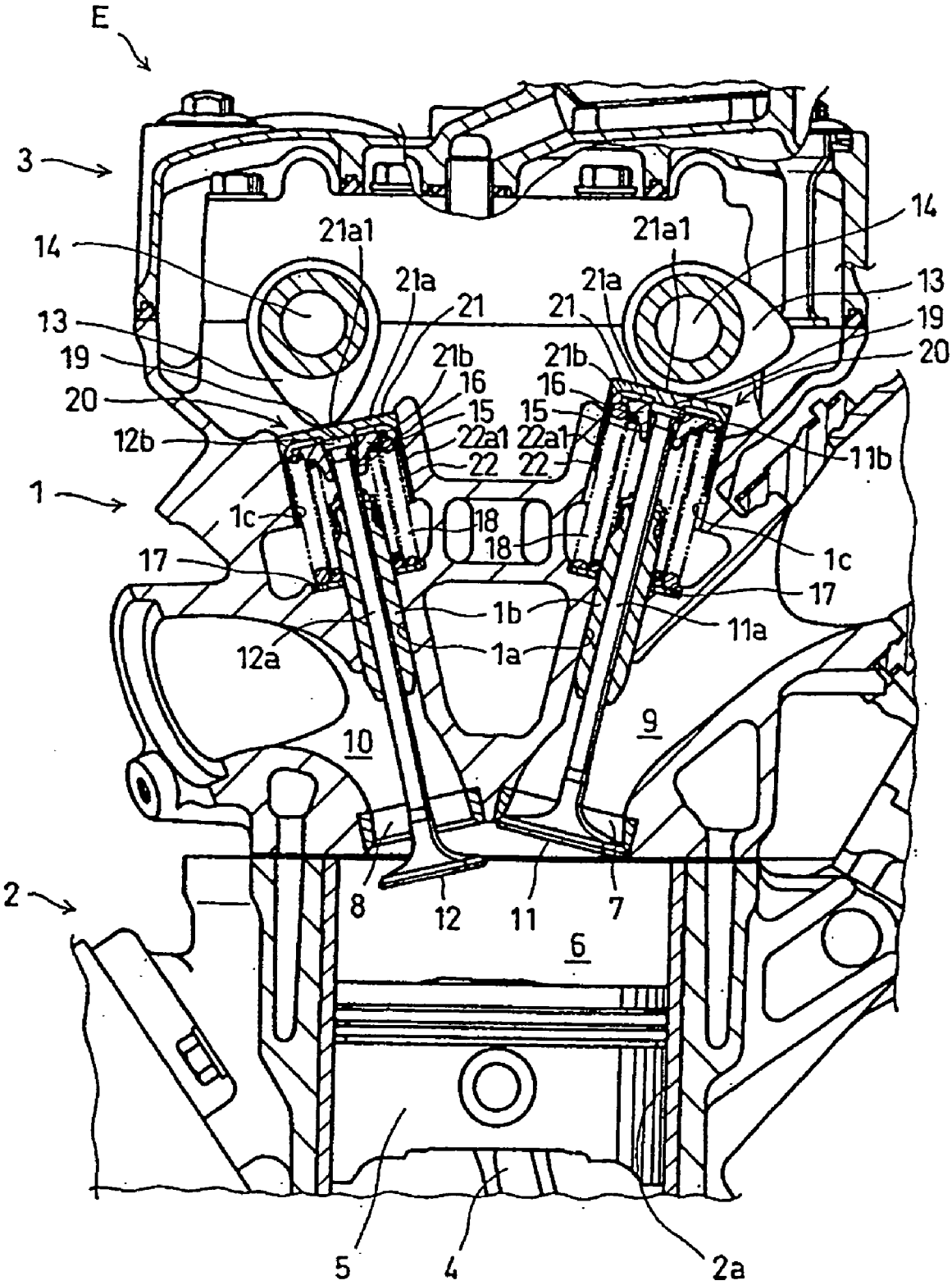
FIG. 1 is a longitudinal sectional view of a cylinder head and adjacent parts of an internal combustion engine, using valve lifters according to a selected illustrative embodiment of the present invention.

FIG. 1 is a side-sectional view of a cylinder head 1 of an internal combustion engine and surroundings. The illustrated engine is of a double overhead cam (DOHC) design. The cylinder head 1 includes a valve train using valve lifters 20 according to a selected illustrative embodiment of the present invention. In particular, the valve lifters 20 each have a concave cam-contacting sliding surface 21*a*1 formed in an upper surface 21 of a lifter body thereof.

The cylinder head 1 is connected and fixed to an upper part of a cylinder block 2, whose lower part is connected and fixed to an upper part of a crankcase (not shown). These three members are fastened to each other with bolts to form a unitary engine body. Furthermore, an upper open portion of the cylinder head 1 is covered with a head cover 3, to form a main portion of the internal combustion engine E.

In the crankcase (not shown), a crankshaft is rotatably supported by one or more bearings, and a crank pin of the crankshaft is connected to a piston 5 through a connecting rod 4, an upper part of which is shown in FIG. 1. In the cylinder block 2, a cylinder bore 2*a* vertically penetrates a central portion of the cylinder block 2, and the piston 5, connected to the connecting rod 4, is fit in the cylinder bore 2*a* so as to reciprocally slide therein.

Kinetic energy, via combustion pressure applied to the piston 5, is transmitted from the piston 5 through the connecting rod 4 and crank pin of the crankshaft to cause rotation of the crankshaft. A combustion chamber 6 to generate the combustion pressure is formed between an upper part of the piston 5 and a lower part of the cylinder head 1.

In the cylinder head 1, the combustion chamber 6 in the lower part, intake and exhaust valve openings 7 and 8, and intake and exhaust ports 9 and 10 are formed. The intake and exhaust valve openings 7 and 8 are opened in an upper wall of the combustion chamber 6. The intake and exhaust ports 9 and 10 communicate with the intake and exhaust valve openings 7 and 8, respectively, and penetrate the cylinder head 1. The intake and exhaust valve openings 7 and 8 are provided with intake and exhaust valves 11 and 12 to open and close the valve openings 7 and 8, respectively. A valve operating apparatus which is a mechanism to operate the intake and exhaust valves 11 and 12 is provided in the upper part of the cylinder head 1 and allows the intake and exhaust valves 11 and 12 to perform operations of opening and closing the valve openings 7 and 8, respectively. The valve operating apparatus includes cams 13 and 13, cam shafts 14 and 14, and the like.

The operations of the intake and exhaust valves 11 and 12 to open and close the intake and exhaust valve openings 7 and 8 are performed by upper tip ends 11*b* and 12*b* of stems 11*a* and 12*a* of the intake and exhaust valves 11 and 12 being pressed by the cams 13 and 13 of the cam shafts 14 and 14 of the valve operating apparatus through the valve lifters 20 and 20. The long stems 11*a* and 12*a* of the intake and exhaust valves 11 and 12 extend upward in stem guide tubes 1*b* and 1*b*, which are fit to open holes 1*a* and 1*a* of a structural part of the cylinder head 1, and slidably fit in the stem guide tubes 1*b* and 1*b* with the upper tip ends 11*b* and 12*b* protruded upward from the stem guide tubes 1*b* and 1*b*.

On the upper tip ends 11*b* and 12*b* of the stems 11*a* and 12*a*, which are protruded upward from the stem guide tubes 1*b* and 1*b*, spring retainers 16 and 16 are fixed through split cotter pins 15 and 15. Between the spring retainers 16 and 16 and the respective spring receivers 17 and 17, which are supported by the cylinder head 1 so as to oppose the respective spring retainers 16 and 16, coil valve springs 18 and 18, which surround the respective stems 11*a* and 12*a*, are provided in compressed states. Action forces of the coil valve springs 18 and 18 always urge the intake and exhaust valves 11 and 12 in a valve closing direction so as to close the intake and exhaust valve openings 7 and 8, respectively.

The upper tip ends 11*b* and 12*b* of the stems 11*a* and 12*a* abut on the respective valve lifters 20 and 20, either directly or with inner shims 19 and 19 interposed therebetween. The valve lifters 20 and 20 have a substantially cylindrical shape with one end closed. The valve lifters 20 each include cylindrical parts 22 and 22, and upper parts 21 and 21, respectively. Each of the upper parts 21 and 21 forms a top wall which closes an opening on an end of a respective cylindrical part 22. Additional description of the valve lifters 20 and 20 is given below.

The aforementioned direct abutments or abutments with the inner shims 19 and 19 interposed of the upper tip ends 11*b* and 12*b* of the stems 11*a* and 12*a* on the valve lifters 20 and 20 are made on respective inner walls (inner surfaces) 21*b* and 21*b* of the aforementioned upper parts 21 and 21. The upper tip ends 11*b* and 12*b* of the stems 11 and 12 are therefore covered with the respective valve lifters 20 and 20. Top walls 21*a* and 21*a* formed into concave surfaces of the upper parts 21 and 21, which form the end walls of the valve lifters 20 and 20, are configured to serve as cam sliding portions 21*a*1 and 21*a*1, which are repeatedly brought into sliding contact with valve operating cams 13 and 13 during engine operation.

The outer peripheries of the cylindrical parts 22 and 22 of the valve lifters 20 and 20 are slidably fit in lifter guide holes 1*c* and 1*c*, which are open in the structural part of the cylinder head 1. Inner peripheries 22*b* and 22*b* (see FIG. 2) of the cylindrical parts 22 and 22 of the valve lifters 20 and 20 are configured to cover the spring retainers 16 and 16, which are fixed to the respective upper tip ends 11*b* and 12*b* of the stems 11 and 12, and outer peripheries of upper portions of the coil valve springs 18 and 18, each of which has an end supported by the corresponding spring retainer 16.

As previously described, the valve operating cams 13 and 13 are in sliding contact with the respective concave top walls 21*a* and 21*a* of the upper parts 21 and 21, which form the upper end walls of the valve lifters 20 and 20. By the rotation operation of the valve operating cams 13 and 13 and the action of the coil valve springs 18 and 18, the outer peripheries of the valve lifters 20 and 20 are slidingly guided in the respective lifter guide holes 1*c* and 1*c* of the cylinder head 1. Since the inner walls 21*b* and 21*b* of the upper parts 21 and 21 of the valve lifters 20 and 20 abut the upper tip ends 11*b* and 12*b* of the stems 11 and 12, the intake and exhaust valves 11 and 12 are selectively reciprocated, at appropriate times, to open and close the intake and exhaust valve openings 7 and 8, respectively.

The valve lifters 20 and 20 are structured such that, in the operations of the aforementioned intake and exhaust valves 11 and 12 to open and close the valve openings 7 and 8, the concave top walls 21*a* and 21*a* of the upper parts 21 and 21, which form the end walls of the valve lifters 20 and 20, are brought into sliding contact with the valve operating cams 13 and 13 and the cylindrical parts 22 and 22 are brought into sliding contact in the lifter guide holes 1*c* and 1*c* of the cylinder head 1.

The structure of the cylinder head 1 of the present invention and surroundings, especially, the structures of the intake and exhaust structural parts, the valve operating apparatus, and surroundings are those described above.

Figure 2:
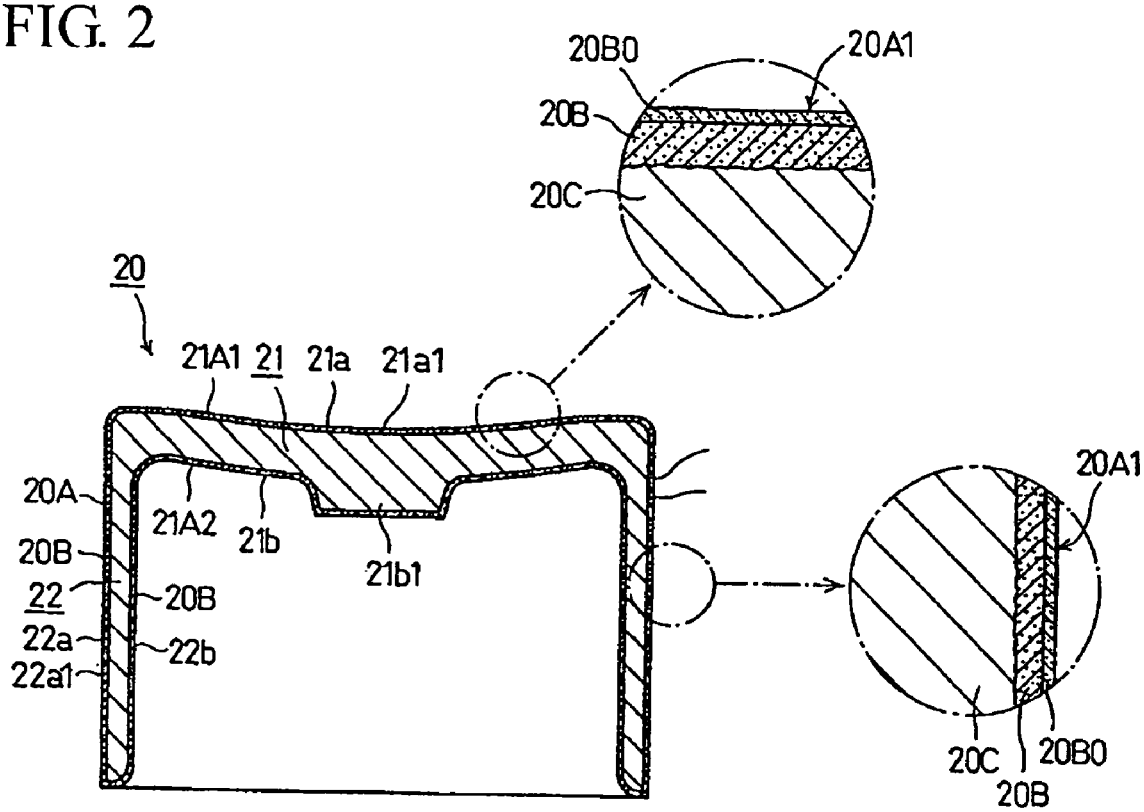
FIG. 2 is a side cross-sectional view of one of the valve lifters used in the engine of FIG. 1, showing the hollow cylindrical shape of valve lifter, and the closed, concave upper end thereof.

Herein, with reference to FIG. 2, a description will be further given of the valve lifters 20 and 20 of this embodiment which are used in the respective valve operating apparatus of the intake and exhaust structural parts. The valve lifters 20 and 20 used in the respective valve operating apparatus of the intake and exhaust structural parts have no difference from one another in structures thereof, and the following description is basically given of only one of the valve lifters 20 and 20, with the understanding that the other valve lifter is substantially identical to the one described.

The valve lifter 20 as a finished product with the cam-contacting sliding surface 21*a*1 formed into a concave shape, as previously described and as shown in an enlarged view in FIG. 2, has a substantially cylindrical shape with a closed end. More specifically, the valve lifter 20 includes the cylindrical part 22, which is straight and has a predetermined length and diameter, and the upper part 21, which forms the top end wall that closes an opening at an end of the cylindrical part 22.

The cylindrical part 22 of the valve lifer 20 is formed so as to have an outer diameter that is a little shorter than the length thereof, and have a substantially constant wall thickness that is a little thinner than that of the upper part 21.

As shown in FIG. 2, the outer wall 21*a* of the upper part 21 of the valve lifter 20 is the previously described concave cam-contacting sliding surface 21*a*1. The upper part 21 has a concavely curved cross sectional shape, with the center part being lowest and both outer sides being the highest. The outer wall 21*a* is therefore formed as the concave surface that is lowest in the center portion thereof. Since what is important is that the cam begins to slide on the cam-contacting sliding surface 21*a*1 at an eccentric position thereof, however, partial shape is not important only if the shape thereof is concave as a whole. The inner wall 21*b* of the top wall 21 is formed as a convex surface bulging in the center, and a protruding portion (protrusion) 21*b*1 extends outwardly and downwardly from the center portion thereof. This protruding portion 21*b*1 is the structure corresponding to the previously-described direct abutment, or abutment through the inner shim 19, on the upper tip end 11*b* (or 12*b*) of the stem (see FIG. 1).

The valve lifter 20 is made of titanium alloy to satisfy requirements of weight reduction and strength. Preferably, the titanium alloy contains 0.3 to 1.50 wt % Fe, 0.20 to 0.70 wt % O, and remainder being Ti and unavoidable impurities.

As previously described, in the operations, the valve lifter 20 comes into sliding contact with the valve operating cam 13 on the concave outer wall 21*a* of the upper part 21 and comes into sliding contact in the lifter guide hole 1*c* of the cylinder head 1 on the outer periphery 22*a* of the cylindrical part 22. These sliding portions 21*a*1 and 22*a*1 in particular are subjected to severe conditions of sliding friction and require high wear resistance and excellent sliding properties. Accordingly, the valve lifter 20, made of titanium alloy, is subjected to a later-described oxidation treatment at high temperature, and a hardened oxygen diffusion layer 20B is formed in a surface 20A of the valve lifter 20 (an outer surface 20A1 and an inner surface 20A2).

In the oxygen diffusion layer 20B formed in the surface 20A of the valve lifter 20 by the oxidation treatment at high temperature, a surface treatment is properly performed for required surface portions. For example, since the concave surface forms the sliding surface 21*a*1 on which the valve operating cam 13 slides, the concave surface of the outer wall 21*a* of the upper part 21 of the valve lifter 20, which is the outer surface 20A1, is finished as a highly accurate surface with good sliding properties. As a result, this surface is therefore properly subjected to surface grinding when needed. The sliding surface 22*a*1 of the outer periphery 22*a* of the cylindrical part 22, on which the lifter guide holes 1*c* slides, is also finished as a highly accurate surface with good sliding properties. As a result, this surface is therefore properly subjected to surface grinding when needed.

The shape of the concave surface of the cam-contacting sliding surface 21*a*1 of the outer wall 21*a* of the upper part 21, which is depressed in the center, increases supply of lubricating oil in sliding contact of the cam-contacting sliding surface 21*a*1 with the valve operating cam 13 and enhances the capability to form an oil film since the depression contributes an improvement in capability to retain lubricating oil. As a result, the sliding properties of the valve operating cam 13 on the cam-contacting sliding surface 21*a*1 is considerably improved, and abnormal wear in the cam-contacting sliding surface 21*a*1 is prevented.

Next, a description is given of the method of manufacturing the valve lifter 20 having the aforementioned structure and including the aforementioned oxygen diffusion layer 20B formed in the entire, or substantially entire, inner and outer both side surfaces thereof.

First Step

Figure 3A:
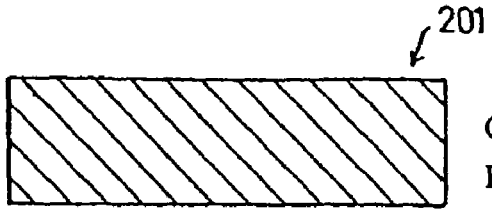
FIG. 3A is a side-sectional view of a valve lifter billet at a first step of manufacture, showing the valve lifter as a solid, disk-shaped billet.

As shown in FIG. 3A, first, as a material forming the valve lifter 20, a bar material of titanium alloy, for example, a round bar of titanium alloy containing 0.96 wt % Fe, 0.28 wt % O, and the remainder being Ti with unavoidable impurities is prepared. A disk-shaped lifter blank or billet 201 is then cut out of the round bar and then subjected to a lubrication treatment.

Second Step

Figure 3B:
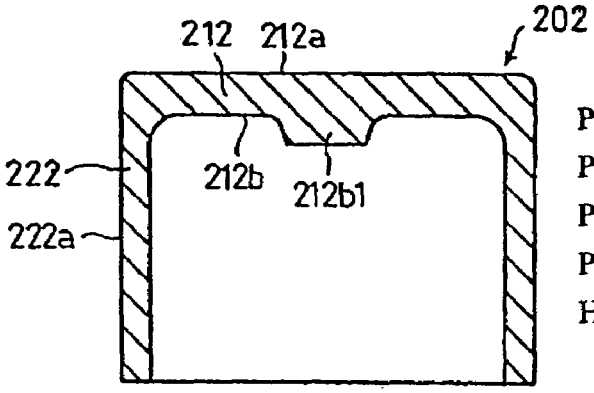
FIG. 3B is a side-sectional view of the valve lifter in a second step of manufacture, showing the valve lifter as a primary processed product having a hollow cylindrical shape with a closed end.

The billet 201 is heated to a forging temperature Tf and then warm-forged to produce a valve lifter primary processed product 202 shown in FIG. 3B, for example, a primary processed product 202 with an outer diameter of 26 mm and a height of 21 mm.

This primary processed product 202 has a substantially cylindrical shape with a closed end. The primary processed product 202 includes a cylindrical part 222 formed as a cylinder part inserted into the lifter guide hole 1*c* of the cylinder head 1 and an upper part 212 which closes an end of the cylindrical part 222 and forms an end wall opposed to the valve operating cam 13. In the center of an inner wall (inner surface) 212*b* of the upper part 212, a protruding portion (a protrusion) 212*b*1 is formed. This protruding portion 212*b*1 is a structure portion used in the previously described direct abutment, or abutment through the inner shim 19, on the valve stem upper tip end 11*b* (12*b*).

In the aforementioned forging, the forging temperature Tf is set to 200° C.<=Tf<=600° C. When the forging temperature Tf is less than 200° C., deformation resistance is high in forging because of insufficient softening, and large load is placed on the mold. On the other hand, when the forging temperature Tf is more than 600° C., an oxidation film is generated in the surface during heating, and fracture is more likely to occur starting from cracks generated in this oxidation film during the forging.

Third Step

Figure 3C:
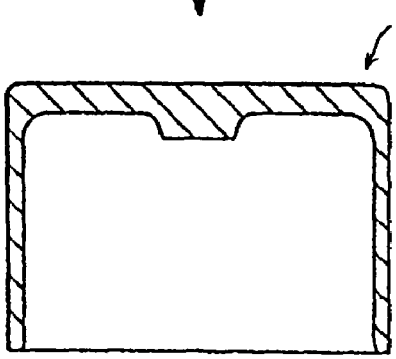
FIG. 3C is a side-sectional view of the valve lifter in a third step of manufacture, showing the valve lifter as a secondary processed product.

The outer peripheral surface of the cylindrical part 222, which is formed as the cylinder part of the valve lifter primary processed product 202, an outer surface (outer wall) of the upper part 212 formed as the end wall, and an annular end surface of the cylindrical part 222 are subjected to machining to produce a valve lifter secondary processed product 203 finished in predetermined size shown in FIG. 3C. The production of the secondary processed product 203 is carried out in consideration that the outer surface of the upper part 212 of the secondary processed product 203 is formed into a concave shape with a depth of 20 μm or less with a phenomenon of hanging down by gravity during the later described oxidation treatment.

Subsequently, the valve lifter secondary processed product 203 is subjected to washing.

Fourth Step

Figure 3D:
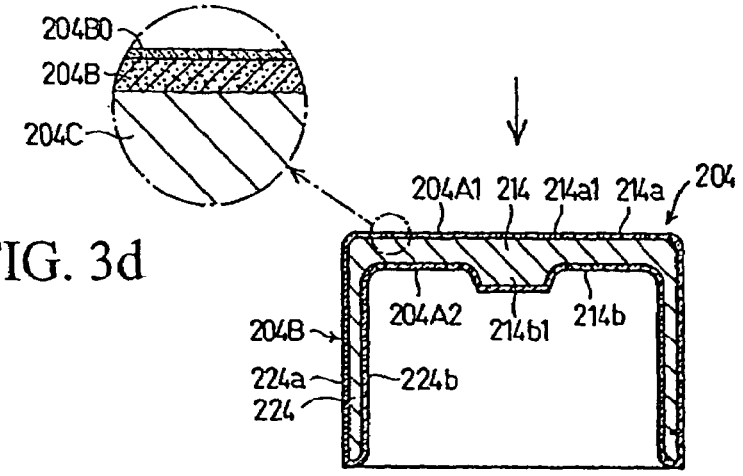
FIG. 3D is a side-sectional view of the valve lifter in the fourth step of manufacture, showing the valve lifter as a tertiary processed product with a hardened outer layer.
Figure 3E:
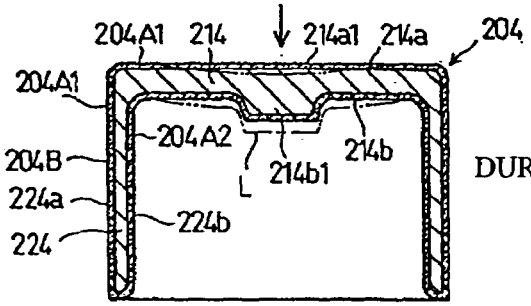
FIG. 3E is a side-sectional view of the valve lifter in the fourth step of manufacture, showing a virtual line L corresponding to the extent of deformation of the upper part of the valve lifter during exposure to high temperature.

The valve lifter secondary processed product 203 is then placed in a heating furnace in air atmosphere and subjected to oxidation treatment in air with a heating temperature T1 set to not less than 600° C., thus obtaining, as shown in FIG. 3D, a valve lifter tertiary processed product 204 as a medium product including an oxygen diffusion layer 204B after the oxidation treatment is formed in the entire surface of the valve lifter second processed product 203.

The oxygen diffusion layer 204B, which is the case-hardened layer, is made thick in the outer surface 204A1 of the valve lifter tertiary processed product 204, especially in a portion where the cam-contacting sliding surface 214*a*1, on which the valve operating cam 13 slides, is formed; and is made a little thinner in the inner surface 204A2. The oxygen diffusion layer 204B after the oxidation treatment is formed in the entire surfaces of the inner and outer surfaces 214A1 and 214A2 of the valve lifter tertiary processed product 204, and an oxide layer 204B0 (shown in the enlarged inset portion of FIG. 4*d*) is formed on a surface of the oxygen diffusion layer 204B as shown in FIG. 3D. The oxide layer 204B0 is formed especially in a portion where the oxygen diffusion layer 204B is formed thick and deep, that is, in the surface of the oxygen diffusion layer 204B, which is the outer surface 204A1 of the valve lifter tertiary processed product 204.

The valve lifter second processed product 203 is heated to the T1>=600° C. in the heating furnace in an air atmosphere for the oxidation treatment, and formed into the previously described valve lifter tertiary processed product 204 with the oxygen diffusion layer 204B formed on the entire surface thereof by the oxidation treatment. During the oxidation treatment in the heating furnace, desirably, the valve lifter tertiary processed product 204 is placed with the upper part 214 (cam-contacting sliding surface 214*a*1), which is formed as an end wall of the processed body 204 with a substantially cylindrical shape, facing up in substantially parallel to the horizontal plane in the step shown in FIG. 3E.

The heated valve lifter tertiary processed product 204 in the oxidation treatment is further softened, by heating at a high temperature. Accordingly, the placement of the tertiary processed product 204 oriented with the upper part 214 (cam-contacting sliding surface 214*a*1) facing up, and substantially parallel to the horizontal plane allows the upper part 214 to sag downwardly during heating as indicated by a virtual line L of FIG. 3E, because of its own weight under the action of gravity, especially because of contribution of the weight of the thick center protruding portion 214*b*1 in the inner wall 214*b* of the upper part 214. The upper part 214 is therefore modified so as to be concavely curved, as seen in the cross section thereof shown in FIG. 3*f*.

Figure 3F:
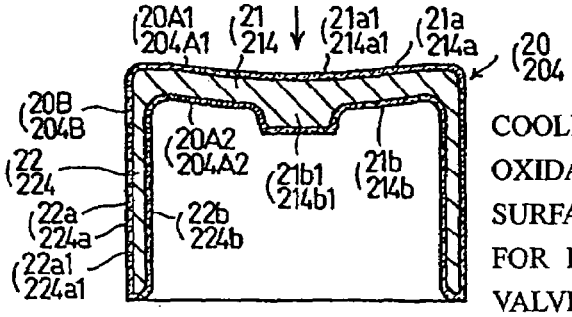
FIG. 3F is a side-sectional view of the valve lifter in the fifth step of manufacture, showing the valve lifter after oxidation and having a concave cross sectional shape.
Figure 4:
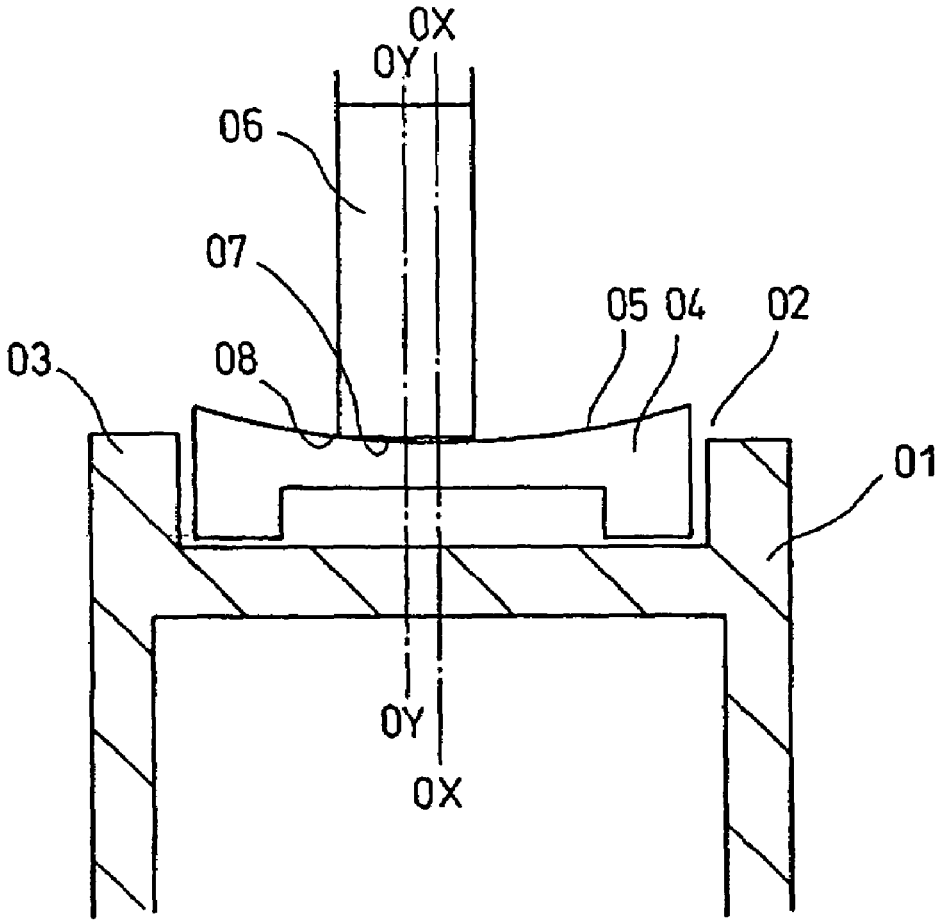
FIG. 4 is side-sectional view of a prior art valve lifter.

Thereafter, the deformation of the valve lifter tertiary processed product 204 is concluded, and as shown in FIG. 3F, the upper part 214 of the processed product 204 has a concavely curved cross section and includes a concave curved surface formed in the outer wall 214*a*, the concave curved surface being composed of the depressed outer wall 214*a*. Note that this embodiment shows a case where the upper part 214 includes a concave curved surface with the center most depressed. However, the upper part 214 is not limited to only this shape, and may have shapes depressed in another place on which the cam 13 slides. This concave curved surface forms the sliding surface 214*a*1 used for sliding contact with the valve operating cam 13, as previously described.

Fifth Step

In the valve lifter tertiary processed product 204 after the oxidation process, as shown in FIG. 3F, the upper part 214, which forms the end wall, is formed to have a concave curved cross section.

The valve lifter tertiary processed product 204 after the oxidation process is then cooled and properly subjected to necessary surface finishing and processing by a machine such as a grinder in required places, thus obtaining the valve lifter 20 as the finished product.

Specifically, the valve lifter tertiary processed product 204 is subjected to a smoothing treatment by removal of all or part of the oxide layer 204B0 on the surface thereof, since the surface of the oxygen diffusion layer 204B is composed of the oxide layer 204B0 generated by the aforementioned oxidation treatment at high temperature. In order to maintain the sliding properties especially in the sliding surface 214*a*1, on which the valve operating cam 13 slides, of the outer wall 214*a* of the upper part 214, which forms the end wall of the valve lifter tertiary processed product 204, and the sliding surface 224*a*1, on which the inner wall of the lifter guide hole c1 slides, of the cylindrical part 222, which forms the cylinder part, and the like, highly precise grinding is performed for smoothing the surface of the oxygen diffusion layer to provide the valve lifter 20 as the finished product.

The valve lifter 20 according to the illustrative embodiment of the present invention includes the aforementioned structure and is manufactured through the aforementioned manufacturing steps to provide the following operations and effects.

In the valve lifter 20 according to the present invention, the cam-contacting sliding surface 21*a*1 of the outer wall 21*a* of the upper part 214, which forms the top end wall of the substantially cylindrical body with a closed end, is formed into the concave surface and therefore provides the function to retain lubricating oil, thus improving the lubrication properties in sliding of the cam 13 on the cam-contacting sliding surface 21*a*1. Moreover, the cam-contacting sliding surface 21*a*1, which is the concave surface, is integrally formed in the upper part 21 of the body of the valve lifter 20, thus simplifying the structure of the valve lifter 20 and reducing the weight thereof. As a result of this simplified structure, the manufacturing cost thereof can be reduced.

The concave surface of the outer wall 21*a* of the upper part is configured to have a maximum depth of not more than 20 μm. Accordingly, edge contact between the sliding surface and the outer periphery of the cam, which is caused when the depth is more than 20 μm, is prevented, and the occurrence of uneven wear in the concave surface is effectively suppressed.

The valve lifter 20 is made of titanium alloy. Accordingly, compared with the valve lifter made of a hard metal, the edge contact between the valve lifter 20 and the cam 13 is suppressed, whereby the elastic characteristics related to the relatively low Young's modulus of the valve lifter 20 are used advantageously, thus reducing the uneven wear in the cam-contacting sliding surface 21*a*1.

The valve lifter 20 (the valve lifter tertiary processed product 204), made of titanium alloy and having been subjected to the oxidation treatment, is placed with the cam-contacting sliding surface 21*a*1 (214*a*1) facing up in an orientation substantially parallel to the horizontal plane during the oxidation treatment, in which it is heated at high temperature. Using the resulting hanging action due to its own weight under the action of gravity and high temperature, the cam-contacting sliding surface 21*a*1 (214*a*1) is therefore formed into the concave cam-contacting sliding surface 21*a*1 (214*a*1). This eliminates the need for special processing for forming the concavity in the cam-contacting sliding surface 21*a*1 (214*a*1), and accordingly reduces the number of manufacturing man-hours, thus reducing the manufacturing cost.

The valve lifter 20 (the valve lifter tertiary processed product 20) includes the protruding portion (protrusion) 21*b*1 (214*b*1) formed in the center of the inner wall (inner surface) 21*b* (214*b*) of the upper part. This portion is thick and heavy, and the formation of the concave cam-contacting sliding surface 21*a*1 (214*a*1), formed by its own weight, is facilitated by the presence of the protruding portion 21*b*1 (214*b*1). Moreover, the center of the concave portion of the cam-contacting sliding surface 21*a*1 substantially matches the center of the upper part 21, therefore, the forming accuracy of the cam-contacting sliding surface 21*a*1 increases.

Furthermore, properly changing the shape of the protruding portion 21*b*1 (214*b*1) can change the shape of the cam-contacting sliding surface 21*a*1 (214*a*1) formed, thus allowing adjustment of the shape of the cam-contacting sliding surface 21*a*1 (214*a*1), which is for sliding of the valve operating cam 13.

Forming the sliding surface of the valve lifter to be convex before the oxidation treatment allows adjustment of the depth of the concave sliding surface after the oxidation treatment. For example, in the case when treating a valve lifter made of titanium alloy containing 0.96 mass % Fe, 0.28 mass % O, and the remainder being titanium and unavoidable impurities at 750° C. for six hours, the sliding surface before the oxidation treatment was formed into a convex surface with the center protruded by 20 μm from the outer peripheral thereof, thus it was possible to obtain a valve lifter in which the sliding surface after the oxidation treatment formed into a concave surface with a maximum depth of 10 μm.

While a working example of the present invention has been described above, the present invention is not limited to the working example described above, but various design alterations may be carried out without departing from the present invention as set forth in the claims.

What is claimed is:

1. A method of manufacturing a valve lifter made of a titanium alloy, the valve lifter comprising a lifter body having a sliding surface for slidably contacting a cam, wherein the sliding surface is integrally formed as an upper surface of the lifter body, and wherein the method comprises the steps of:

orienting the valve lifter with the sliding surface facing upwardly, and performing an oxidation treatment on the valve lifter such that the sliding surface is formed in a concave shape;

wherein the oxidation treatment step is carried out in a heated oxidizing environment, and wherein the sliding surface becomes concave as a result of the oxidation treatment step.

2. The method of manufacturing a valve lifter according to claim 1, wherein the oxidation treatment step comprises heating the valve lifter to a temperature of not less than 600 degrees Celsius in an oxidizing environment, thereby forming an oxygen diffusion layer on an outer surface of the valve lifter.

3. The method of manufacturing a valve lifter according to claim 2, wherein the oxidizing environment comprises air.

4. The method of manufacturing a valve lifter according to claim 1, wherein the valve lifter comprises a protrusion which is situated on the lifter body such that, when the valve lifter is assembled in an engine, the protrusion abuts directly on an end portion of an intake or an exhaust valve, or indirectly abuts on an intake or an exhaust valve with an inner shim interposed between the protrusion and the intake or exhaust valve, wherein the protrusion is formed in a central portion of an inner surface of an upper part of the lifter body.

5. The method of manufacturing a valve lifter according to claim 1, wherein the sliding surface of the valve lifter is formed into a convex shape before the oxidation treatment.

6. A method of manufacturing a valve lifter made of a titanium alloy, the valve lifter comprising a lifter body having a sliding surface for slidably contacting a cam, wherein the sliding surface is integrally formed as an upper surface of the lifter body, and wherein the method comprises the steps of:

orienting the valve lifter with the sliding surface facing upwardly; and performing an oxidation treatment on the valve lifter such that the sliding surface is formed in a concave shape, wherein the following method steps are performed before the valve lifter is oriented with the sliding surface facing up:

forming a disk-shaped billet from a titanium alloy;

warm-forging the disk-shaped billet to form a primary processed product having a hollow cylindrical shape and a closed end; and machining at least a portion of an outer surface the primary processed product to form a secondary processed product.

7. The method of manufacturing a valve lifter according to claim 1, further comprising a step of finely finishing a portion of the exterior surface of the valve lifter using precise grinding to remove at least part of an oxide layer from the exterior surface of the valve lifter, wherein said finishing step is performed after the valve lifter undergoes the oxidation treatment step.

* * * * *